US006197742B1

(12) United States Patent
Ramachandran et al.

(10) Patent No.: US 6,197,742 B1
(45) **Date of Patent: *Mar. 6, 2001**

(54) SILICONE COMPOSITION FOR BAR SOAP APPLICATIONS

(75) Inventors: K. N. Ramachandran, Karnataka; G. Sudesh Kumar, Ulsoor Bangalore, both of (IN)

(73) Assignee: General Electric Company, Pittsfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/477,980

(22) Filed: Jan. 5, 2000

Related U.S. Application Data

(60) Division of application No. 09/360,827, filed on Jul. 26, 1999, now Pat. No. 6,051,546, which is a continuation-in-part of application No. 08/993,973, filed on Dec. 18, 1997, now Pat. No. 5,981,465.

(30) Foreign Application Priority Data

Oct. 28, 1997 (IN) ..... 2040/97

(51) Int. Cl.[7] ..... C11D 1/83; C11D 3/08; C11D 3/20

(52) U.S. Cl. ..... 510/466; 510/130; 510/141

(58) Field of Search ..... 510/130, 152, 510/153, 141, 466

(56) References Cited

U.S. PATENT DOCUMENTS

| | | | | |
|---|---|---|---|---|
| 4,450,152 | | 5/1984 | Ona et al. . | |
| 4,609,750 | * | 9/1986 | Kollmeier et al. | 556/419 |
| 4,842,850 | * | 6/1989 | Vu | 424/70 |
| 5,045,225 | * | 9/1991 | Aronson et al. | 252/174.15 |
| 5,154,849 | | 10/1992 | Visscher et al. . | |
| 5,164,522 | | 11/1992 | McCarthy et al. . | |
| 5,211,883 | * | 5/1993 | Yamashina et al. | 252/546 |
| 5,254,269 | * | 10/1993 | Taylor et al. | 252/86 |
| 5,312,559 | | 5/1994 | Kacher et al. . | |
| 5,372,804 | | 12/1994 | Khoshdel et al. . | |
| 5,505,937 | * | 4/1996 | Castrogiovanni et al. | 424/64 |
| 5,599,483 | * | 2/1997 | Mizushima et al. | 510/119 |
| 5,602,091 | | 2/1997 | Monson et al. . | |
| 5,616,758 | | 4/1997 | McCarthy et al. . | |
| 5,629,273 | | 5/1997 | Hauenstein . | |
| 5,661,120 | | 8/1997 | Finucane et al. . | |
| 5,690,918 | * | 11/1997 | Jacks et al. | 424/64 |
| 5,725,845 | * | 3/1998 | Krog et al. | 424/64 |
| 5,773,397 | * | 6/1998 | Tanake et al. | 510/119 |
| 5,891,126 | * | 4/1999 | Osbord, III et al. | 604/385.1 |
| 5,912,002 | * | 11/1999 | Grieveson et al. | 424/401 |
| 5,945,092 | * | 8/1999 | Krog et al. | 424/64 |
| 5,981,465 | * | 11/1999 | Ramachandran et al. | 510/466 |
| 6,015,546 | * | 4/2000 | Ramachandran et al. | 510/466 |

FOREIGN PATENT DOCUMENTS

| | | |
|---|---|---|
| 752846A1 | 1/1997 | (EP) . |
| WO 9628140A1 | 9/1996 | (WO) . |

OTHER PUBLICATIONS

Method to determine silicones on human hair by atomic absorption spectroscopy, Journal of the Society of Cosmetic Chemist, vol. 30, Nov./Dec. 1988 p. 383–392.

Notes, On the Narrow Miscibility Gap in Polymer 1–Polymer 2–Solvent Ternary Systems, vol. 8, No. 3, May–Jun. 1975, p. 371–373.

The Compatibilization of Polymer Blends by Strong Interactions and Reactions; Alamgir Karim, Jack F. Douglas, Yi Feng, Bradford J. Factor, Frederick I. Mopsik, and Charles C. Han; Strong Interaction and Reachtt;://www.msel.nist-.gov/structure/polymers/techactv95//compatplblnd.html, Dec. 1997.

Use of Fouier Transform infrared spectroscopy with attenuated total reflectancefor in vivo quantitation of polydimethylsiloxanes on human skin, J. Soc. Cosmet. Chem., 37, (Mar./Apr. 1986), p. 73.

* cited by examiner

*Primary Examiner*—Yogendra Gupta
*Assistant Examiner*—Christine Ingersoll
(74) *Attorney, Agent, or Firm*—Kenneth S. Wheelock

(57) ABSTRACT

A method for increasing surface deposition of silicone from soap and improving processing characteristics of soap and a corresponding composition are disclosed. The composition includes a fatty alkyl silicone, a fatty silicate ester, a high viscosity lower alkyl silicone fluid, a silicone surfactant, and an organic surfactant. The organic surfactant is one or more of a nonionic, cationic or anionic surfactant, a fatly ester sulfonate, sorbitan monostearate, and sodium lauryl sulfate.

5 Claims, No Drawings

SILICONE COMPOSITION FOR BAR SOAP APPLICATIONS

CROSS REFERENCE TO RELATED APPLICATIONS

This is a divisional of application Ser. No. 09/360,827 filed on Jul. 26, 1999, now U.S. Pat. No. 6,051,546 which is a continuation-in-part of application Ser. No. 08/993,973 filed on Dec. 18, 1997, now issued U.S. Pat. No. 5,981,465.

FEDERALLY SPONSORED RESEARCH

Not applicable

FIELD OF THE INVENTION

The invention relates to silicone additives for bar soaps.

BACKGROUND OF THE INVENTION

Soaps are widely used as skin cleansers, cleaning skin effectively and economically. However, they are not particularly mild. Soaps irritate skin, resulting in reddening, roughening and dryness. Therefore, materials which can counteract the irritating effects of soap, including moisturizers, synthetic surfactants and silicones are commonly included in the formulation of a soap bar.

Silicones have long been known to provide a light, silky feel on hair and skin. However, when silicones are incorporated in bar soaps, they have a tendency to wash off along with the soap, leaving no silicone residue on the skin. When silicones are added to bar soaps in the form of fluids, they tend to become emulsified and the emulsion is washed away with the lather of the soap. Therefore, even very viscous fluids fail to provide the sensory benefits of silicones when applied through bar soaps. Compositions containing silicones also show reduced lather formation.

Surprisingly, it has now been discovered that when a blend of a fatty alkyl modified silicone, a fatty silicate ester, a high viscosity fluid silicone, a silicone surfactant and a nonionic/cationic/anionic organic surfactant are incorporated in a bar soap, enough silicone is deposited on the skin surface to provide superior sensory benefits while maintaining the lathering and cleaning properties of the soap. Further, the film deposited is not highly stable, so an undesirable build up of silicone on the surface over time is avoided.

The present composition offers the flexibility to incorporate the silicones using nonionic, cationic and anionic surfactants in bar soap formulations based on very different oil-based raw materials. The composition can be used as an emulsion and added to soap noodles or converted to a granular additive with conventional fillers and added directly to soap during amalgamation. The practical difficulty of mixing high viscosity fluids during soap manufacture is therefore overcome.

The use of silicones in cleansing bar compositions has been disclosed in U.S. Pat. No. 5,154,849 to Visscher et al., issued Oct. 13, 1992 and in U.S. Pat. No. 5,661,120 to Finucane et al., issued Aug. 26, 1997. The silicones disclosed, however, are difficult to incorporate in a soap bar because of their high viscosity. The art does not suggest a blend of long chain substituted silicones and short chain substituted silicones with organic surfactants.

SUMMARY OF THE INVENTION

In one aspect, the invention relates to a composition for improving the surface deposition of silicones comprising: (a) 0.1 to 10 parts of a fatty alkyl silicone; (b) 0.1 to 10 parts of a fatty silicate ester; (c) 30 to 90 parts of a high viscosity lower alkyl silicone fluid; (d) 0.1 to 10 parts of a silicone surfactant; (e) 1 to 20 parts of an organic surfactant. The organic surfactant comprises one or more of: (a) a surfactant chosen from the group of nonionic, cationic and anionic surfactants; (b) a fatty ester sulfonate; (c) sorbitan monostearate; and (d) sodium lauryl sulfate.

DETAILED DESCRIPTION OF THE INVENTION

In its most basic aspect, the invention relates to a method for improving the surface deposition of silicone and a corresponding composition for a soap bar additive with improved deposition of silicone on the skin. The composition comprises: a high viscosity fluid silicone, a fatty alkyl silicone, a fatty silicate ester, a silicone surfactant, and an organic surfactant.

An essential component of the present compositions is a high viscosity fluid silicone which is present at a level which is effective to deliver a skin sensory benefit, for example, from 30 to 90 parts by weight, and preferably from 58 to 61 parts by weight per 100 parts of a soap additive composition. High viscosity fluid silicone, as used herein, denotes a silicone with viscosity ranging from about 5 to about 600,000 centistokes. Silicone fluids useful in the present invention may be polyalkyl siloxanes, polyaryl siloxanes, or polyalkylaryl siloxanes of suitable viscosity and molecular weight. The polyalkyl siloxanes that may be used herein include, for example, polydimethyl siloxanes. These siloxanes are commercially available, for example, from the General Electric Company as the Viscasil® series. The polyalkylaryl siloxanes that may be used include, for example, polydimethyphenyl siloxanes and poly (dimethyl) (diphenyl) siloxanes. These materials are also commercially available from GE Silicones. The preferred silicone fluids for use in these compositions are polydimethyl siloxanes with viscosities ranging from about 500 to about 100,000 cst.

The organic surfactants useful herein may be selected from cationic, anionic, and nonionic polymers suitable for contact with human skin. When used herein, the term 'organic surfactant' refers to a surfactant containing two or more carbon atoms covalently bonded and not containing any silicon. These components are generally present from about 1 to 20 parts per 100 parts of the additive composition, preferably from about 4.5 parts to 9 parts. Preferred anionic surfactants for use in the present compositions are sodium laureth-7 sulfate, commercially available as Sipon ES-7 by Alcolac and diethylene glycol monooleate, commercially available from Croda Chemical Ltd. as Cithrol DGMO S/E. Preferred cationic surfactants are dicocodimethylammonium chloride, designated M-Quat-2475 and manufactured by Mazer, and N-(3-chloroallyl) hexaminium chloride, commercially available as Cosept 200 from Costec, Inc. Preferred nonionic surfactants are the laurylether polyoxyethylenes commercially available as Brij 30 and Brij 35 by ICI India, and higher and lower molecular weight versions. The sodium salt of a sulfonated fatty ester with hydroxy end groups is commercially available as Eastman AQ 55 S from Eastman Chemical Co.

The compositions of the present invention additionally contain a fatty alkyl silicone and a fatty silicate ester. For the purposes of this invention, fatty is defined as a branched or straight alkyl chain of from ten to thirty carbon atoms. An example of a fatty alkyl silicone useful for the present invention is cetearyl methicone. A preferred fatty silicate ester is diisostearyl trimethylolpropane siloxy silicate. The fatty alkyl silicone may comprise 0.1 to 10 parts by weight per 100 parts of a soap additive composition, and preferably, about 1 part; the fatty silicate ester may also comprise 0.1 to 10 parts by weight per 100 parts of a soap additive composition, and preferably, about 1 part.

Suitable silicone surfactants for use in these compositions are commercially available from GE Silicones. These may include, for example, a mixture of cyclomethicone and dimethicone copolyol. The silicone surfactant may be present in the soap additive composition at 0.1 to 10 parts by weight per 100 parts of the soap additive, and preferably, at about 1 to 9 parts by weight.

The present compositions may optionally include a soap filler. Any of the standard fillers which are used in the manufacture of soap bars may be used. An example of a useful filler composition is soap powder/talc/treated silica. A filler may be included in the present compositions at levels from about 100 to 1000 parts by weight per 100 parts soap additive composition, and preferably 200 to 600 parts.

The soap of the present invention may be any of the widely-known alkali metal or alkanol ammonium salts of aliphatic alkane or alkene monocarboxylic acids, prepared by hydrolysis of vegetable oils to monoglycerides and subsequent saponification of the monoglycerides. Sodium, potassium, mono-, di-, and tri-ethanol ammonium cations, or combinations thereof, are typically used. The aliphatic acids generally contain about 12 to 22 carbon atoms, preferably about 12 to 18 carbon atoms. They may be described as alkali metal carboxylates of acyclic hydrocarbons having about 12 to about 22 carbon atoms.

EXAMPLES

The following non-limiting examples describe the compositions of the present invention, and the method of making and using them. Soap bars prepared using these compositions have improved deposition of silicone on the skin and resulting sensory benefits, while maintaining acceptable lathering and cleansing properties.

TABLE 1

| INGREDIENT | EXAMPLE | | | | | | | | | | | |
|---|---|---|---|---|---|---|---|---|---|---|---|---|
| (in grams) | 2 | 3 | 4 | 5 | 6 | 7 | 8 | 9 | 10 | 11 | 12 | 13 |
| Viscasil ® 60M | 1 | | | | | 60 | 60 | 60 | 60 | 60 | 60 | 60 |
| Viscasil ® 60M emulsion | | 1 | | | | | | | | | | |
| Viscasil ® 100M | | | 1 | | | | | | | | | |
| Cetearyl methicone | | | | | | 1 | 1 | 1 | 1 | 1 | 1 | 1 |
| Diisostearyl trimethylolpropane siloxy silicate (DTSS) | | | | | 1 | | 1 | 2 | 1 | 1 | 1 | 1 |
| Silicone surfactant | | | | | | 6 | | | 1 | 1 | 1 | 1 |
| Dimethicone Copolyol | | | | | | | | 1 | | | | |
| Organic Surfactant - Anionic | | | | | | | | | 9.5 | | | |
| Organic Surfactant -Nonionic | | | | | | | | | | 9.5 | | |
| Organic Surfactant - Cationic | | | | | | | | | | | 9.5 | |
| Organic Surfactant - Anionic, Filled | | | | | | | | | | | | 9.5 |
| Water | 0 | 0 | 0 | 0 | 0 | to 100 | to 100 | to 100 | to 100 | to 100 | to 100 | 0 |

The organic surfactants used in Examples 9–13 were prepared as shown in Table 2.

TABLE 2

| | ORGANIC SURFACTANT | | | |
|---|---|---|---|---|
| INGREDIENT | ANIONIC | NONIONIC | CATIONIC | ANIONIC-FILLED |
| Laurylether polyoxyethylene (4) | | 55.12 | | |
| Laurylether polyoxyethylene (23) | | 38.59 | | |
| Sorbitan monostearate | 0.55 | 0.55 | 0.55 | 0.55 |
| Fatty ester sulfonate | 5.51 | 5.51 | 5.51 | 5.51 |

TABLE 2-continued

| INGREDIENT | ORGANIC SURFACTANT | | | |
|---|---|---|---|---|
| | ANIONIC | NONIONIC | CATIONIC | ANIONIC-FILLED |
| Sodium lauryl sulfate | 0.22 | 0.22 | 0.22 | 0.22 |
| Sodium laureth - 7 sulfate | 55.12 | | | 55.12 |
| Cithrol DGMO S/E | 38.59 | | | 38.59 |
| Dicocodimethyl ammonium chloride | | | 55.12 | |
| N-(Chloroallyl) Hexaminium chloride | | | 38.59 | |

The compositions of the examples in Table 1 were prepared by mixing the components as listed in the table, and then adding 1 gram of the composition to 100 grams soap noodles. The soap mixture was blended and made into soap bars.

The organic surfactant compositions of Examples 10 -13 were prepared by the following method:

An anionic, cationic, or nonionic surfactant, 38.6 grams, was melted to liquid form as necessary, and 55.12 grams of a second anionic, cationic, or nonionic surfactant and 0.55 grams sorbitan monostearate were added. Sodium lauryl sulfate (0.22 grams) was added to 5.5 grams of a solution of Eastman AQ 55 S in water (28 grams in 100 ml.) and the resulting solution was added to the sorbitan monostearate mixture.

For the sample with filler, Example 13, the water was omitted. Instead, 400 grams of a soap powder/talc/treated silica filler was added to the surfactant blend before mixing with the silicone component. This resulted in a granular material which was easily incorporated in a soap bar.

In order to demonstrate the improved surface deposition of the compositions of the present invention, soap bars containing the components listed in Table 1 were prepared. The controls, Examples 2–6, were compared to soap bars made with various silicone blends and with the compositions of the present invention. The soaps were evaluated for skin feel and the relative amount of silicone deposited by each composition, termed % retention, was determined.

Percent retention was determined by quantitative IR analysis using a Nicolette FTIR spectrometer. Working standards of cyclomethicone solutions were prepared in the concentration range of 0.15 mg/g–26 mg/g. The IR spectrum of each solution was recorded. A calibration procedure was developed based on partial least mean square centering. The peak area under the Si-Me absorption band at 1260 nm was considered for quantification. The calibration curve was linear throughout the concentration range of the silicone solutions used. The slope and intercept of the calibration curve followed an equation for a straight line.

For each experimental composition, a solution of 1 gram soap in 100 grams water was prepared. The solution was applied to a substrate with a brush and allowed to dry for 20 to 30 minutes. The quantity applied was determined by the difference between the weight of the solution bottle plus the brush before and after the solution was applied. After application and drying, the site was rinsed with water and the rinse water was collected. The silicone content of the rinse water was determined from the area under the peak for the Si-Me absorption at 1260 nm.

The following equation was used for the calculation of % retention:

% Retention=(Silicone applied%13 Silicone washed off)×100/Silicone applied

Results of the Retention analysis appear in Table 2. Retention was less than 30% for soaps formulated with the silicone controls, and less than 80% for those made with the organic modified silicones. In contrast, soaps prepared using the compositions of the present invention had an impressive surface silicone retention of 93%–97%.

TABLE 3

| EXAMPLE | SILICONE APPLIED (mg/g) | SILICONE WASHED OFF (mg/g) | RETENTION % |
|---|---|---|---|
| 2 | 9.10 | 6.40 | 29 |
| 3 | 4.83 | 4.00 | Negligible |
| 4 | 9.10 | 6.20 | 24 |
| 5 | 8.60 | 3.90 | 54 |
| 6 | 8.60 | 2.80 | 67 |
| 7 | 4.90 | 1.48 | 70 |
| 8 | 5.00 | 1.45 | 71 |
| 9 | 5.00 | 1.20 | 76 |
| 10 | 9.80 | 0.69 | 93 |
| 11 | 9.60 | 0.51 | 95 |
| 12 | 9.60 | 0.48 | 94 |
| 13 | 9.80 | 0.35 | 96 |

Skin feel was evaluated subjectively by applying a soap solution using a brush to a section of the forearm using a standard wash - rinse procedure of 15 soap rubs and 10 water rinses. The compositions of the invention also had improved skin feel over the controls.

We claim:

1. A bar soap additive composition for improving the surface deposition of silicone comprising:

(a) cetearyl methicone;

(b) a fatty silicate ester;

(c) a high viscosity lower alkyl silicone fluid selected from the group consisting of polyalkyl siloxanes, polyarylsiloxanes, and polyaklyaryl siloxanes all with suitable viscosity and molecular weight;

(d) a silicone surfactant; and (e) an organic surfactant wherein said organic surfactant comprises:

(i) dicocodimethylammonium chloride;

(ii) N-(3-chloroallyl)hexamminium chloride;

(iii) a fatty ester sulfonate;

(iv) sorbitan monostearate; and (v) sodium lauryl sulfate, said organic surfactant containing two or more carbon atoms covalently bonded and not containing any silicone.

2. The composition of claim 1, wherein the fatty silicate ester is diisostearyl trimethylolpropane siloxy silicate.

3. A composition according to claim 1 comprising:

(a) cetearyl methicone;

(b) diisostearyl trimethylolpropane siloxy silicate;

(c) polydimethyl siloxane;

(d) a silicone suifactant; and (e) said organic surfactant.

4. A composition according to claim 1 comprising:

(a) about 1 part cetearyl methicone;

(b) about 1 part diisostearyl trimethylolpropane siloxy silicate;

(c) 58 to 61 parts polydimethyl siloxane;

(d) 1 to 9 parts silicone surfactant; and (e) 4.5 to 9 parts of said organic surfactant.

5. The composition of claim 4 wherein said organic surfactant comprises:

250 parts of dicocodimethylammonium chloride;

175 parts of N-(3-chloroallyl)hexaminium chloride;

25 to 50 parts of a fatty ester sulfonate;

0 to 25 parts sorbitan monostearate; and 0 to 1 part sodium lauryl sulfate.

* * * * *